United States Patent [19]

Robbins

[11] 4,440,047

[45] Apr. 3, 1984

[54] UNI-DIRECTIONAL DRIVE WRENCH

[76] Inventor: Christopher B. Robbins, 2719 N. Pollard, Arlington, Va. 22207

[21] Appl. No.: 336,335

[22] Filed: Dec. 31, 1981

[51] Int. Cl.[3] ..... B25B 13/12

[52] U.S. Cl. ..... 81/179; 81/186

[58] Field of Search ..... 81/129, 179, 186, 58.2, 81/DIG. 6; 411/402–407, 427

[56] References Cited

U.S. PATENT DOCUMENTS

| | | | |
|---|---|---|---|
| 1,865,346 | 6/1932 | Wells | 411/427 |
| 2,563,878 | 8/1951 | Sigsbey | 81/179 |
| 2,592,781 | 4/1952 | Yavner | 81/179 |
| 2,712,259 | 7/1955 | Cowell | 81/179 |
| 2,721,493 | 10/1955 | Bergland | 81/179 |
| 2,959,996 | 11/1960 | Wheeler | 81/179 |
| 3,003,379 | 10/1961 | Pribitzer | 411/427 X |
| 3,165,015 | 1/1965 | Hinrichs | 81/179 |
| 3,527,327 | 9/1970 | McCreary | 81/58.2 X |
| 4,361,412 | 11/1982 | Stolarczyk | 411/402 |

*Primary Examiner*—Frederick R. Schmidt
*Assistant Examiner*—Debra S. Meislin
*Attorney, Agent, or Firm*—Larson and Taylor

[57] ABSTRACT

A wrench, formed as an open box wrench or to completely encircle a nut comprises a drive insert for at least two opposed nut faces. Each drive insert engages its respective nut face over the full length of the latter. A guideway for each drive insert has parallel sides arranged at an angle such that upon applying torque, the drive insert will not move into the recess, while on the reverse stroke the insert will easily move into the recess. The facing surfaces of the drive insert and the nut may be provided with a cooperating projection and recess.

10 Claims, 11 Drawing Figures

UNI-DIRECTIONAL DRIVE WRENCH

BACKGROUND OF THE INVENTION

This invention relates to a wrench, and in particular it relates to a new and improved uni-directional high torque wrench.

On many occasions it is desired to operate a wrench to tighten a nut or bolt (whichever has the plurality of outwardly facing flat surfaces engagable by the wrench), in such a manner that the wrench drives the nut or bolt in one direction of rotation and slips over the faces of the nut or bolt in the opposite direction so that the wrench can be brought back for the next torque transmitting stroke without removing the wrench from the operative surfaces of the nut or bolt. (Hereinafter the term "nut" will be used, but it is understood that the term is generic to either a nut or a bolt having such plurality of axially extending radially facing tool engaging faces.) It is also known that such wrenches, referred to as uni-directional wrenches, can completely encircle the nut or can be open ended to permit the wrench to engage a nut laterally which cannot be engaged axially, e.g. if the nut is on an elongated pipe, the ends of which are not available. One type of device known heretofore for such a purpose is a ratchet wrench as shown for example in U.S. Pat. Nos. 2,537,175; 2,691,315; 2,693,123; 3,175,434. However, such ratchet wrenches have several disadvantages. Firstly, they have a relatively large number of moving parts, rendering them rather complex and costly to manufacture. Additionally, the relatively small teeth on a ratchet wrench cannot be used for high torque applications.

To provide a uni-directional wrench having higher torque possibilities, it is also known to provide a wrench, usually an open ended box wrench, including one or more wedge like elements so positioned in the wrench that in the torque transmitting position the nut urges the wedge against a stop means, preventing further movement thereof and causing the wrench to transmit torque to the nut, while in the return direction the wedge is moved out of the way, permitting the nut to turn relative to the interior surfaces of the wrench. Such devices are shown in the following U.S. patents: Randall, U.S. Pat. No. 770,699; Morrison, U.S. Pat. No. 1,308,440; Yavner, U.S. Pat. No. 2,592,781; Yavner, U.S. Pat. No. 2,646,711; Lane, U.S. Pat. No. 2,697,372; Bergland, U.S. Pat. No. 2,721,493; Blasdell, U.S. Pat. No. 2,795,160; Yavner, U.S. Pat. No. 2,855,814; Akers, U.S. Pat. No. 2,910,902; Akers, U.S. Pat. No. 2,937,551; Stambaugh et al, U.S. Pat. No. 3,023,654; Thompson, U.S. Pat. No. 3,717,054; Doan, U.S. Pat. No. 4,255,990.

While these wedge type wrenches are an improvement over conventional ratchet wrenches as a high torque uni-directional wrench, they are still subject to several disadvantages. The difficulty is that in these known devices the direction of movement of the wedge is essentially parallel to the nut face (viewing the nut and wedge in an axial direction) and this creates several problems which can be illustrated with respect to the Thompson U.S. Pat. No. 3,717,054 and the Lane U.S. Pat. No. 2,697,372. First, the structure associated with the lower portion of these wedges, i.e. the spring means and the recess in the wrench head, are relatively bulky and extend in such a direction that it would not be possible to provide a plurality of such drive means, one for each face of the nut. Secondly, during the torque application step, the torque is applied to the wedges in a highly disadvantageous manner. Specifically, the highest torque forces are applied against the weakest portions of the wrench structure. For example, in Lane the torque is applied by the top surface of wedge 14 against the surface 10. In Thompson the greatest force is applied by pin 8 against the interior of recess 16. These are relatively small surfaces for receiving such large forces, thereby raising the possibility of the tool distorting or rupturing. A third disadvantage of these known wrenches using wedges is that the force necessary to depress the wedges to their non-torque transmitting locations requires moving the wedges in a direction which forms such an acute angle with the corresponding face of the nut that such movement is difficult at best and requires the nut to move around the wedge to engage it closer to its outer end to push it into its recess. Because the position of the nut must then be moved around within the wrench, sufficient room for such movement must be provided. This additional room prevents the possibility of designing a wrench having separate wedges or other drive means engaging each one of or at least a plurality of continuous faces about the surface of the nut.

Hence, there exists a need to provide a new and improved uni-directional wrench capable of applying high torque and not having the disadvantages of previously known uni-directional wrenches.

SUMMARY OF THE INVENTION

Hence, it is a purpose of the present invention to provide a new and improved uni-directional wrench which overcomes the disadvantages of previously known devices.

This purpose of the present invention is achieved by providing drive inserts in the head of the wrench corresponding to respective faces of the nut to be driven, whereby each drive insert may include a face which matches with the entire length of a nut face (taken in the circumferential direction) and no more, thus making it possible to provide other drive inserts for adjacent nut faces. Additionally, whether the wrench is turned in the torque transmitting or return direction, the turning axes of the wrench and nut remain coincident. Otherwise if the turning axis of the wrench moved relative to the turning axis of the nut during the return movement of the wrench, such relative movement between the wrench and the nut would render it difficult if not possible to provide drive inserts of the present type for a plurality of adjacent nut faces.

Each insert is mounted in a guideway formed at such an angle to its respective nut face that when torque is transmitted the forces will drive the nut and during the return stroke of the wrench the drive insert will easily slip into its guideway to permit such return movement.

The features of the present invention can be provided in a closed wrench which completely encircles the nut or an open "box" wrench which permits the wrench to be applied laterally to the nut faces.

The features of the present invention can be adapted for different shaped nuts, the most common nuts being the square and hexagonal nuts. While drive inserts are preferably provided for all nut faces (excepting of course those faces which face the opening in a box wrench), it is possible to achieve the results of the present invention in certain cases by providing only two opposed drive inserts.

In accordance with another advantageous feature of the present invention, a matching projection and recess may be provided on facing drive insert and nut faces. The projections and recesses would normally be engaged but would be disengaged upon limited movement in the direction which moves the inserts into their guideways. Such projections and recesses would be particularly suitable for engaging and holding a socket wrench. In this case the wrench would be a drive tool and the "nut" would actually be the socket of a socket wrench.

Thus, it an object of this invention to provide a new and improved uni-directional torque wrench.

It is another object of this invention to provide a uni-directional torque wrench having drive inserts so shaped and designed that inserts may if desired be provided for any plurality of contiguous nut faces.

It is still another object of this invention to provide an improved uni-directional torque wrench of the type described, wherein the advantageous features can be utilized for either a completely enclosed wrench or an open box wrench.

It is still another object of the present invention to provide a uni-directional torque wrench of the type described which is capable of absorbing considerably greater forces than was the case with wedge type uni-directional wrenches known heretofore.

It is still another object of the present invention to provide an improved uni-directional torque drive of the type described wherein the drive inserts take up relatively little room, in the radial direction, thereby permitting space to provide such drive inserts for a plurality of contiguous nut faces.

It is still another object of the present invention to provide a uni-directional torque drive of the type described having features which are adaptable to different shaped nut faces.

It is still another object of the present invention to provide a uni-directional torque wrench of the type described including providing matching projections and recesses on facing nut and drive insert faces.

These and other objects of the present invention will become apparent from the detailed description to follow, together with the accompanying drawings.

BRIEF DESCRIPTION OF THE DRAWINGS

There follows a detailed description of preferred embodiments of the present invention to be read together with the accompanying drawings wherein.

DETAILED DESCRIPTION OF THE PREFERRED EMBODIMENTS

There follows a detailed description of preferred embodiments of the present invention wherein like numerals will represent like elements throughout the several views.

Figure 1:
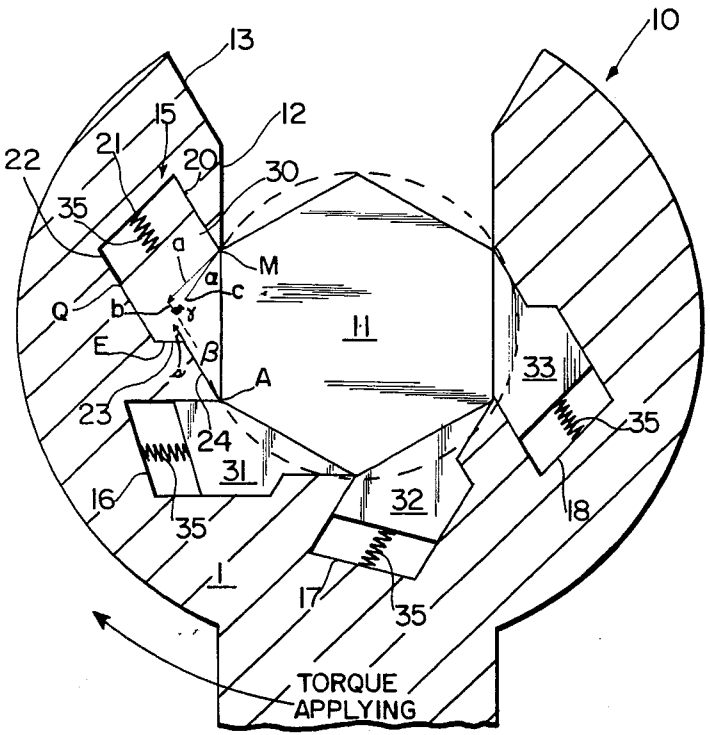
FIG. 1 is a central cross sectional view of a first embodiment of a uni-directional wrench of the present invention showing the wrench in a torque transmitting position.

Referring to FIG. 1 there is shown a uni-directional wrench 10 constructed and shaped to drive a hexagonal nut such as nut 11 shown in the drawing. Although a wrench according to the present invention may completely enclose the nut or be an open box wrench, FIG. 1 illustrates the open box wrench having an opening 12 permitting the wrench to be moved laterally onto the sides of the nut 11. Tapered entrance 13 facilitates movement of the wrench onto the nut. As mentioned above, the term "nut" is used generically to include either a nut or a bolt having a plurality of side faces adapted to be engaged by a wrench for rotating the nut or bolt.

A feature of the present invention is that each individual drive means is constructed and arranged to cooperate with a single face of the nut in a way which does not interfere with the other faces, leaving room for additional drive means to be provided for other nut faces, even a plurality of contiguous nut faces. This is made possible by a number of the features to be described below, the result of which is that each individual drive means takes up relatively little space (circumferentially and radially) in the drive wrench and the turning axis of both the nut and the wrench remain coincident during the turning of the wrench in both the torque transmitting direction and the return direction.

Referring to FIG. 1 a plurality of guideways 15, 16, 17 and 18 are provided for each of the four nut faces which do not face towards the opening 12. Each guideway has therein a drive insert 30, 31, 32 and 33, respectively, each of which is urged in a direction outwardly of its guideway by a coil spring 35.

Figure 2:
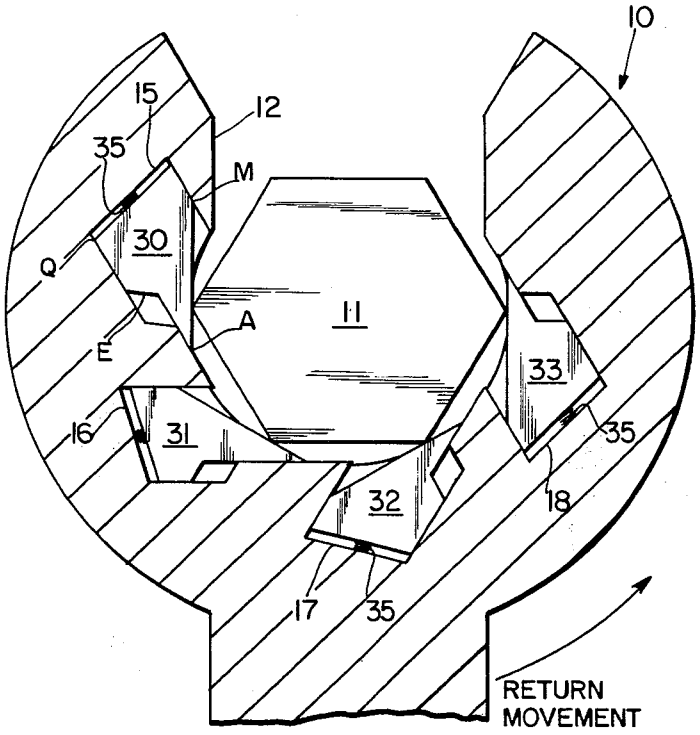
FIG. 2 is a view similar to FIG. 1 but showing the elements during a return wrench movement.
Figure 3:
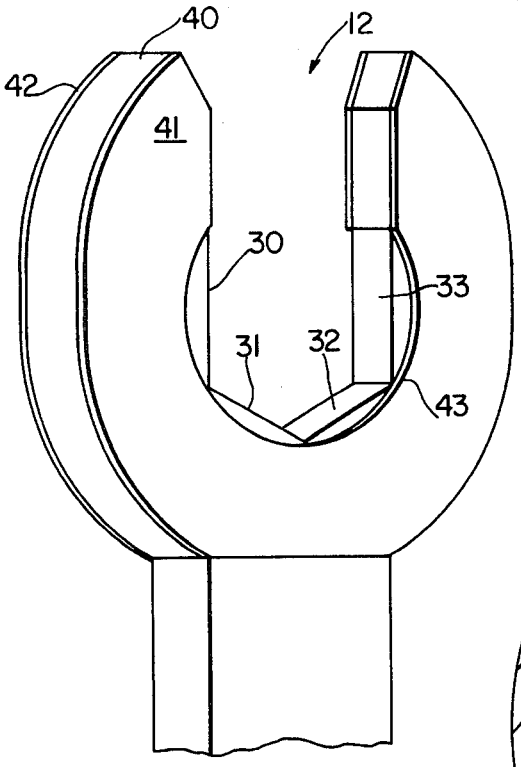
FIG. 3 is a perspective view of the wrench of FIGS. 1 and 2.
Figure 4:
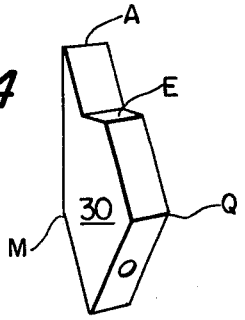
FIG. 4 is an enlarged perspective view of a drive insert of FIGS. 1–3.

Since all four drive means are identical, only one of them, namely the drive insert 30 in the guideway 15 will be described in detail. To better understand the description, reference is also made to FIG. 2 which shows the wrench during a return movement and also the perspective views of FIGS. 3 and 4.

The guideway 15 includes a short side 20, a bottom 21, and a long side 22 having a step 23. The inside end of 22 is labeled 24. Faces of the drive insert 30 are bounded by corners labeled with letters, the drive face engaging the nut face lying between points A and M. The torque transmitting face of the drive insert extends from point A to point Q, including the step E which faces step 23 of the guideway. Reference will also be made to the circle T which includes the corners of the nut 11.

During a torque transmitting movement the force along guideway face 22 is transmitted to the drive insert 30 via face Q-A and across the face M-A to the nut. This driving force is opposed by a reactive force which is represented by arrow c in FIG. 1, this force being tangent to circle T at point M. This force c is resolvable into forces a and b perpendicular to and parallel to guideway wall 22 (excluding the step), respectively. To facilitate describing the present invention, reference will also be made to a triangle formed by force c, the plane of guideway wall 24 and the corresponding nut face which at this time is coincident with face A-M. The angles formed thereby are labeled $\alpha$, $\beta$, and $\gamma$.

A wrench according to the present invention can be constructed in accordance with any suitable procedure known to those skilled in the manufacturing arts. However, as one suitable example, referring to FIG. 3, a central portion of the wrench 40 having the guideways formed therein and including the handle could be formed as one piece, for example by casting. Cover plates 41 and 42 would then be applied on either side by suitable means such as gluing, bolts or the like to close off the outer sides of the guideways. The cover plates 41 and 42 must be cut back at least to the circle 43 in FIG. 3 which corresponds to the nut circle T of FIG. 1.

Referring to FIG. 1, it is desirable to have the torque transmitting force, represented by vector c, absorbed by as great a portion as possible of the guideway wall 22. The spreading of this drive force over this large area is one reason why the wrench of the present invention is suitable for exerting rather large drive forces. As a minimal requirement, this means that force vector "a" must intersect the side of the drive insert between points Q and A.

Angle $\gamma$ should be more than 90° so that its resolution into a force perpendicular to wall 22 will include a vector b pointing out of the guideway to assure that the step E of the drive insert is forced against step 23 of the guideway. In the limit condition, however, considering that friction exists between the moving parts, angle $\gamma$ can be a right angle. However, if angle $\gamma$ becomes less than 90°, when the wrench is turned in the torque applying direction, the insert will simply move into its guideway rather than apply torque. Another limitation concerns the angle $\beta$ between the nut face lying on plane A-M and the wall 24. Preferably this angle is such that wall 24 lies on the tangent to circle T at point A. Referring to FIG. 1, this will provide the least resistence during return movement of the wrench to the force "s" parallel to guidewall 24 which depresses the insert 30 into the guideway against the force of spring 35. If the angle $\beta$ becomes any smaller so that angle $\beta$ is less than angle $\alpha$ (as is the case for example in many of the prior art "wedge" wrenches described earlier in this specification) the insert is blocked from moving into the recess. In the prior art this obstacle was overcome by moving the wrench axis relative to the nut axis so that the nut would "come around" to direct its wedge depressing force more along the axis of the wedge.

Another force to be considered is the force of step E against step 23. Ideally, this force should be minimized, the main function of this step being to limit outward movement of insert 30 under the force of spring 35. To accomplish this, steps E and 23 are preferably located in a plane perpendicular to the nut face lying on plane A-M. If the angle of step 23 is reduced, bringing it closer to the planes of 22 and 24, then as torque is applied the insert will tend to jam between the nut face and the wall 22 in the manner of a door jam. If the angle of steps 23 and E is increased in the opposite direction from said illustrated perpendicular arrangement, then it will reduce the force applicable from the wrench to the nut face which of course is undesirable.

Figure 5A:
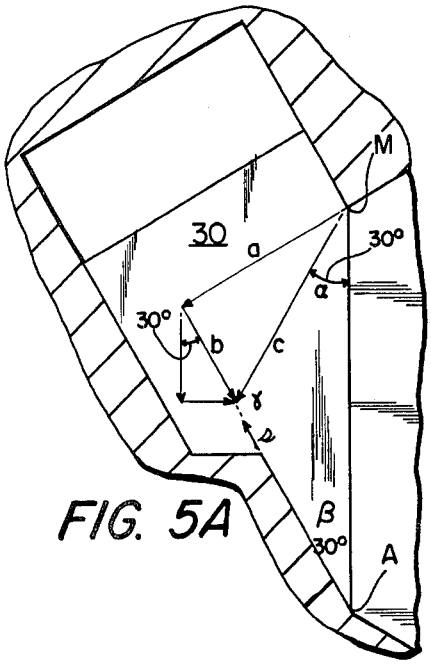
FIGS. 5A and 5B are diagrammatic views illustrating the forces applicable to two differently shaped drive inserts, both adaptable for use in the embodiments of FIGS. 1 through 4, and illustrating the applicable forces for the two different shapes.
Figure 5B:
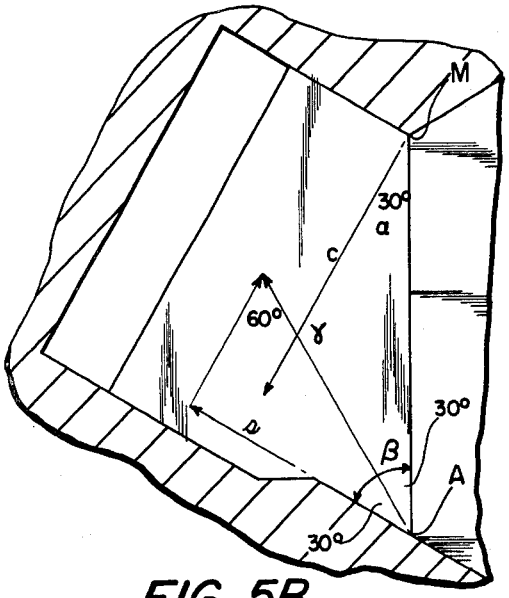

FIGS. 5A and 5B illustrate preferable limit conditions for the angles $\alpha$, $\beta$, and $\gamma$ for use with a hexagonal nut. In FIG. 5A angle $\gamma$ is 30° while angle $\alpha$ is 30°. With this arrangement the force seating the drive insert 30 against the nut is maximized while reverse torque applied along the tangent of circle T is desirably parallel to the guidewalls 22 and 24 and thereby minimized. However, the force against the seating face, i.e. steps E and 23 is maximized which is not desirable. In FIG. 5B wherein $\beta$ equals 60°, the drive force tangent to circle T at point A is in fact perpendicular to walls 22 and 24, meaning that the drive force is maximized. Also the seating force between steps 23 and E is minimized which is also desirable. However, the force against the nut face is minimized relative to that applied in FIG. 5A and the forces required in reverse to depress the insert 30 into its guideway is greater than in FIG. 5A because the force is applied at an angle to the tangent of circle T at point A. However, with the design of FIG. 5B this force is not so great that the axis of the wrench must be moved relative to the axis of the nut in reverse.

Selection of the proper angle $\beta$ as between FIGS. 5A or 5B or somewhere inbetween would depend upon the particular application of the wrench. For example, for an extra heavy-duty wrench the arrangement of FIG. 5B would be preferred since it maximizes the force transferred from the wrench head to the drive insert and minimizes the seating force between faces 23 and E.

Figure 6:
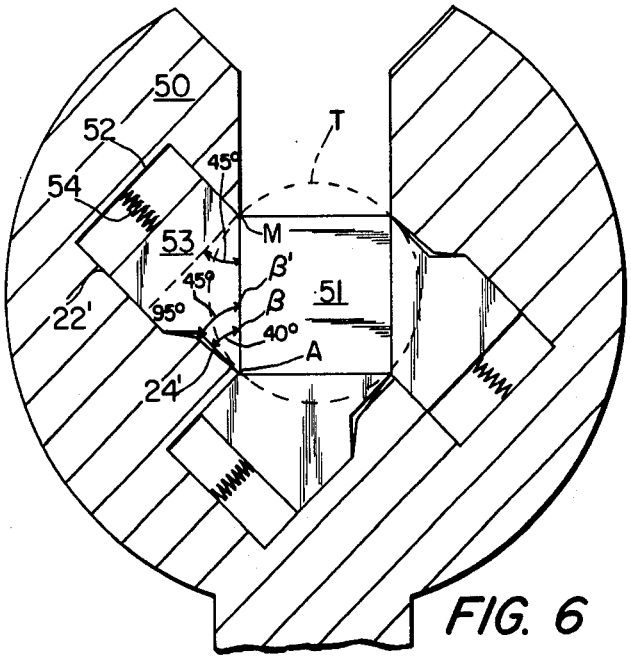
FIG. 6 is a central cross sectional view similar to FIG. 1 but showing the present invention adaptable for use with a square nut.

FIG. 6 illustrates a modification 50 of the present invention constructed for use with a square nut 51. It includes three guideways 52, each having therein an insert 53 urged outwardly by a spring 54. In applying the design features which were described above with respect to a hexagonal nut to the square nut embodiment of FIG. 6, the angle $\beta$ which would place the guideway side walls parallel to the tangent of circle T at point A would be 45°, meaning that angle $\alpha$ would also be 45° because the drive vector c from point M would be perpendicular to opposed guide wall faces 22' and 24'. Unfortunately, this does not include a force vector pushing the insert out of the guideway 52 and hence when torque is applied, the insert 53 could be depressed into its guideway 52. To offset this, using the analogy of FIG. 5B, the angle $\beta$ could be reduced, for example to 40°, whereby the angle $\gamma$ would be 95°. Under these conditions when torque is applied the insert 53 would not be depressed into the recess 52. On the other hand, to permit insert 53 to move into its recess during return movement, the side 24' must form an angle of at least 45° with MA, as shown at $\beta'$ in FIG. 6.

Figure 7:
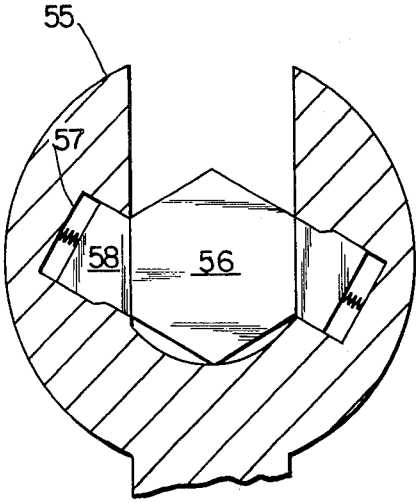
FIG. 7 is a central cross sectional view similar to FIG. 1 but showing a modification thereof utilizing only two drive inserts for a hexagonal nut.

The basic features of the present invention provide a drive insert having a face which mates with a nut face along its complete length, taken in the circumferential direction, and wherein the insert does not interfere with adjacent faces, it leaves room for drive inserts cooperating with adjacent nut faces and wherein the turning axis of the nut and wrench remain coincident during both the torque applying and return strokes. While these features permit drive inserts to be applied to all faces, the goals of the present invention may be achieved if drive inserts constructed in accordance with the present invention are provided for only two opposed faces. Such an embodiment is illustrated in FIG. 7 which shows a wrench 55 for turning a hexagonal nut 56 including a pair of opposed drive inserts 58 in recesses 57. Although all of the above described considerations concerning the angles $\alpha$, $\beta$ and $\gamma$ apply as well to an embodiment having only two opposed drive inserts, there is shown in FIG. 7 for purposes of illustration two drive inserts arranged with the angles as shown in FIG. 5B.

Figure 8:
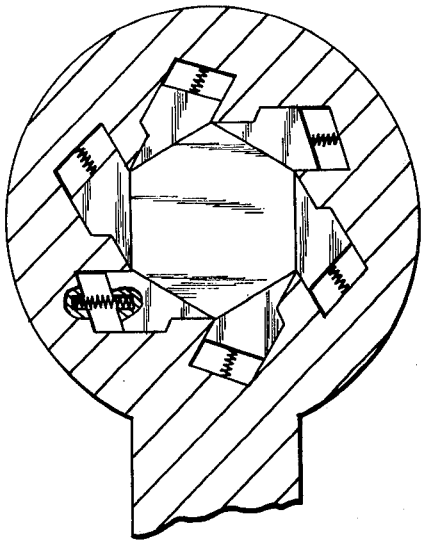
FIG. 8 is a central cross sectional view similar to FIG. 1 but showing a completely enclosed wrench rather than an open box wrench.

All embodiments thus far have been of the open slot box type wrench which of course is highly advantageous for permitting a wrench to move laterally onto a nut which might otherwise be unaccessible. However, if one desires to construct an enclosed wrench which completely encircles its respective nut, the present invention is equally applicable to such a wrench for any number of nut faces. Such a wrench constructed for cooperating with a hexagonal nut is shown in FIG. 8.

The present invention has been described especially with respect to hexagonal and square nuts since these are the most common type. However, it will be apparent that if so desired the basic features of the present invention can be modified and adapted for nuts of any configuration.

Figure 9:
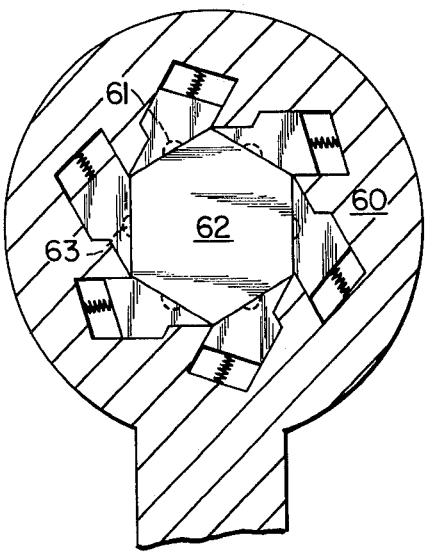
FIG. 9 is a central cross sectional view similar to FIG. 8 but showing a modification of the present invention.
Figure 10:
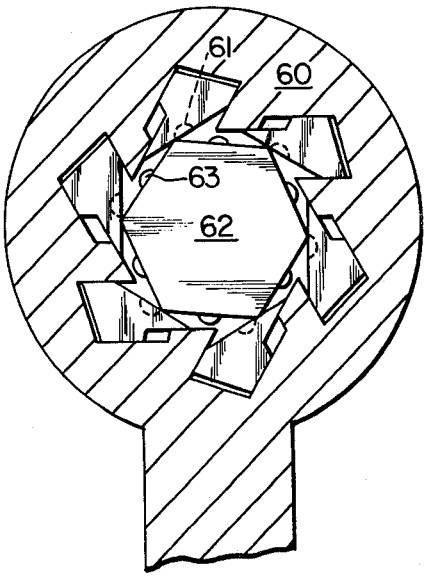
FIG. 10 is a central cross sectional view similar to FIG. 9 but showing the parts moved to a different position.

FIGS. 9 and 10 illustrate another embodiment of the invention which includes a modification and which is adaptable for different uses. Structurally, the drive tool 60 of FIGS. 9 and 10 includes recesses 61 formed into the faces of the drive inserts, which recesses cooperate with projections 63 on a drive nut 62. In one advantageous application of this embodiment the nut 62 may be the socket of a socket wrench, the interior of which is shaped to mate with a nut to be driven. To engage the socket 62 the wrench 60 is moved axially partially onto the exterior of socket 62 (at this time the inserts are moved to their innermost position as shown in FIG. 9) until the raised projections 63 limit movement of the wrench. The wrench is then given a half twist in the reverse direction to depress the inserts, reaching the position of FIG. 10. Now axial movement of the wrench 10 onto the socket is completed and the wrench is given a half twist in the forward direction to seat the inserts on the faces of the socket 62 with the projections 63 within the recesses 61. This procedure is reversed to remove the wrench from the socket. This feature may be used to hold the socket wrench 62 in the wrench 60 when conveying the socket wrench to and from the location at which the nut is to be driven by the wrench. Also the fact that this wrench drivingly engages the socket wrench on the side (rather than at the end) means that the socket wrench may be hollow from end to end. This would facilitate using a short socket wrench to drive a nut along a long threaded surface since the end of the long threaded surface would simply pass out the other end of the socket as the nut was tightened down the threaded surface.

Although the invention has been described in considerable detail with respect to preferred embodiments thereof, it will be apparent that the invention is capable of numerous modifications and variations, apparent to those skilled in the art, without departing from the spirit and scope of the invention.

I claim:

1. A wrench for turning a nut of the type having an even number of flat sides, comprising:

at least two drive means positioned to apply turning torque simultaneously to opposing sides of a nut upon rotation of the wrench in a drive direction, and to slip about the nut upon turning of the wrench in the opposite direction while the center of the nut and the center of the wrench remains substantially coincident, each drive means including a guideway open toward the wrench interior and having essentially parallel first and second sides, as viewed in the axial direction, a drive insert in each guideway slidable into and out of the guideway and urged outwardly by a spring means, said drive insert having first and second parallel sides parallel to the slidable along said first and second parallel sides of the guideway, said drive insert also having an end face which engages a flat side of the nut, the width of each insert, between said first and second sides, being large enough for the said end face of the drive insert to engage the corresponding flat side of a nut across its full face, taken in the circumferential direction, means for limiting outward movement of the drive insert, and an acute angle between a line extending through the guideway parallel to its sides and the plane of said end face being greater than an acute angle between said end face and a tangent to a circle through the corners of the nut, so that upon reverse turning of the wrench, relative to the nut, each drive inert can move into its respective guideway, to allow the nut to slip past that drive insert, and said acute angle being sufficiently small that upon turning the wrench in the driving direction, the drive insert will exert a driving force on the nut, and not be forced into the guideway.

2. A wrench according to claim 1, said means for limiting comprising a step in said first side of the guideway and a corresponding step in the drive insert, to limit outward movement of the drive insert, and wherein said step is generally perpendicular to the said side of the nut.

3. A wrench according to claim 1 or claim 2, the nut being hexagonal and the angle between said first side of the guideway and said flat face of the nut being between 30° and 60°.

4. A wrench according to claim 3, the wrench being an open box wrench comprising four drive inserts for cooperation with four contiguous sides of the nut.

5. A wrench according to claim 3, the interior of the wrench forming a full circle about the nut, and including six inserts, one for each side of the nut.

6. A wrench according to claim 1 or claim 2, the said nut being square and the angle between the said first side of the guideway and said flat face of the nut being approximately 45°.

7. A wrench according to claim 6, the wrench being an open box wrench with an opening for a distance of one side of the square nut to which the wrench is applicable, and including three of said drive inserts for engaging three continuous faces of the square nut.

8. A wrench according to claim 1 or claim 2, the wrench completely encircling the nut and having four drive inserts, one for each of the nut faces.

9. A wrench according to claim 1, the wrench completely encircling the nut, and each nut face and mating drive insert face having a raised projection in one and a cooperating recess in the other, which projection and recess are located centrally, taken in the circumferential direction, with the projection in the recess when a nut face directly faces a drive insert face, and which projection and recess separate when the wrench is turned about its axis relative to the nut.

10. A wrench according to claim 9, wherein the nut is a socket, the outer surface of which is of nut shape and cooperating with the drive insert face, and wherein the socket includes interior engagement surfaces for engaging an object to be rotated.

* * * * *